United States Patent [19]

Rodriguez

[11] 4,029,943

[45] June 14, 1977

[54] METHOD AND APPARATUS FOR OPINION SURVEYS

[76] Inventor: Henry Rodriguez, 8834 Saturn St., Los Angeles, Calif. 90035

[22] Filed: Dec. 12, 1975

[21] Appl. No.: 640,079

[52] U.S. Cl. ..... 235/57; 235/56; 235/1 B; 235/1 R; 235/52; 235/90

[51] Int. Cl.[2] ..... G07C 13/02

[58] Field of Search ..... 235/1 B, 90, 57, 56, 235/52, 1 R; 209/122, 110; 35/9 D, 17, 73; 273/148 A; 211/10, 11, 12

[56] References Cited

UNITED STATES PATENTS

| | | | |
|---|---|---|---|
| 266,379 | 10/1882 | Masters | 273/148 A |
| 365,386 | 6/1887 | Kirk | 211/12 |
| 626,423 | 6/1899 | Hargens | 35/73 X |
| 1,083,776 | 1/1914 | Thompson | 211/10 X |
| 1,162,853 | 12/1915 | Fitzpatrick | 235/57 X |
| 1,191,857 | 7/1916 | Van Houten | 211/11 |
| 1,416,437 | 5/1922 | Balch | 209/122 |
| 1,514,270 | 11/1924 | Thomson | 35/73 |
| 1,603,776 | 10/1926 | Joly | 211/11 |
| 2,494,030 | 1/1950 | Blondin | 211/11 |

*Primary Examiner*—Ulysses Weldon

[57] ABSTRACT

Beginning with data cards which carry thereon a question or a statement to be a subject of a survey, such cards being pre-punched with appropriate indicia signifying the question being asked or the position being tested, the interviewer submits such position or question-carrying card to the interviewee who, upon reading the question or statement to himself, selects one of several possible categories between two extremes, as represented by a slot in a sequentially designated series of slots in a container, inserts such card in the selected slot representing his degree of agreement or disagreement with the question or position statement, such card being automatically received by an envelope marked correspondingly to the designation adjacent the slot, for later sorting and computer compilation of all the cards in each envelope and survey results which are free, to a maximum degree, from interviewer influence of interviewee.

5 Claims, 4 Drawing Figures

METHOD AND APPARATUS FOR OPINION SURVEYS

BACKGROUND OF THE INVENTION

1. Field of the Invention

This invention relates to opinion surveys or poll-taking and, more specifically, to apparatus and methods for conducting such surveys or polls with maximum accuracy.

2. Prior Art

Opinion surveys, or polls, have become popular working tools for politicians, sociologists, statisticians, criminologists and many others wishing to predict or explain mass attitudes of the populace or segments thereof. The standard technique in conducting such a poll or survey is, after designating the interviewees to be sampled, to design a questionnaire which, typically, has multitudinous questions, with many of the questions having extensive subparts. The subparts may call for the application by an interviewee of a subjective scaling of his answer — e.g., "on a scale of 1 to 9 which classification would you give to your answer, 1 being equivalent to a flat 'yes' and 9 being equivalent to an unequivocal 'no'?"

With prior-art techniques the interviewer had to spend a great deal of time presenting the question, oftimes introducing his own biases or pre-disposition in the process. This has been particularly true when the interviewer or the questionnaire is operating in a language which is not the interviewee's first language. Inconsistencies and errors were the results. These errors were further compounded when the answers were coded, prior to card keypunch operations, and further errors could and did occur in the keypunch operations. The overall result was, for any particular survey, the probability of significant error in the survey and in the interpretation of those results.

Therefore, it is a primary object of this invention to provide a method and apparatus for implementing that method which avoids, in poll-taking or opinion surveys, the errors inherent in prior methods and apparatus for conducting such surveys.

It is a further object of this invention to provide a method and apparatus which eliminates from the results of opinion surveys errors arising from interviewer bias and language limitations of the interviewee.

It is a still further object of the present invention to provide a method and apparatus for conducting opinion surveys which eliminates human mechanical errors in coding and keypunching of interview data.

It is an additional object of the present invention to provide a method and apparatus which produces in the results of an opinion survey the maximum accuracy of representation of one or more interviewee's responses.

SUMMARY OF THE INVENTION

Stated briefly, in conducting an opinion survey, or poll-taking, utilizing the method and apparatus of my invention the questions or position statements which are to represent the thrust of the survey are recorded individually, in an appropriate language or languages, on individual computer cards which have been prepunched to signify the particular question or position statement, the individual cards are handed to each interviewee by the interviewer after the interviewee or respondent has been given oral or written instructions in his most facile language as to how to use what I call the "vignette box," an important part of my invention, including instructions on inserting the individual cards in the vignette box's slots numbered 1 through 9 (1 representing the greatest degree of agreement and 9 the least degree of agreement by the respondent). After the responding member of the poll population has had adequate time to ponder the position he wishes to take on the issue, he inserts the card bearing the recitation of that issue on its face in the slot which represents his degree or gradation of concurrence or disagreement with the issue or question. The card thus placed falls into an envelope bearing the same number, 1 through 9, carried by the associated slot. After each interview or polling is completed, the top of the vignette box is removed and the envelopes, with their punch-card contents, are sealed.

The sealed envelopes are sent to a computer center for processing.

The individual envelopes are held open to receive the cards by means of spreaders which may be formed simultaneously with the forming of the slots. The bottom edge of each envelope rests on a base within the vignette box, that base being sloped forwardly so that, when the top of the vignette box is removed, should an envelope fall off its associated spreaders, it will fall with its open edge upwardly oriented and will not spill its contents, namely the punchcards inserted therein by the interviewee or interviewees.

Separate demographic and biographical information may be taken on each participant and his responses isolated from those of each other participant by replacing the envelopes associated with each slot prior to each interview or sample, and transmitting to the computer center (or other central processing point) such demographic and biographical information for each respondent along with his responses.

The method and apparatus according to my invention reduces costs by:

1. Eliminating the layout and printing of questionnaires.
2. Eliminating the coding of answers preparatory to keypunching;
3. Eliminating the individualized keypunching; and
4. Reducing the normally-required programmer's manhours by utilizing the pre-punched vignette cards.

At the same time survey accuracy is increased and many of the vagaries normally attributed to poll-taking are eliminated.

BRIEF DESCRIPTION OF THE DRAWINGS

A better understanding of the present invention may be had from a consideration of the following detailed description, taken in conjunction with the accompanying drawing, in which.

DESCRIPTION OF THE PREFERRED EMBODIMENT

Figure 1:
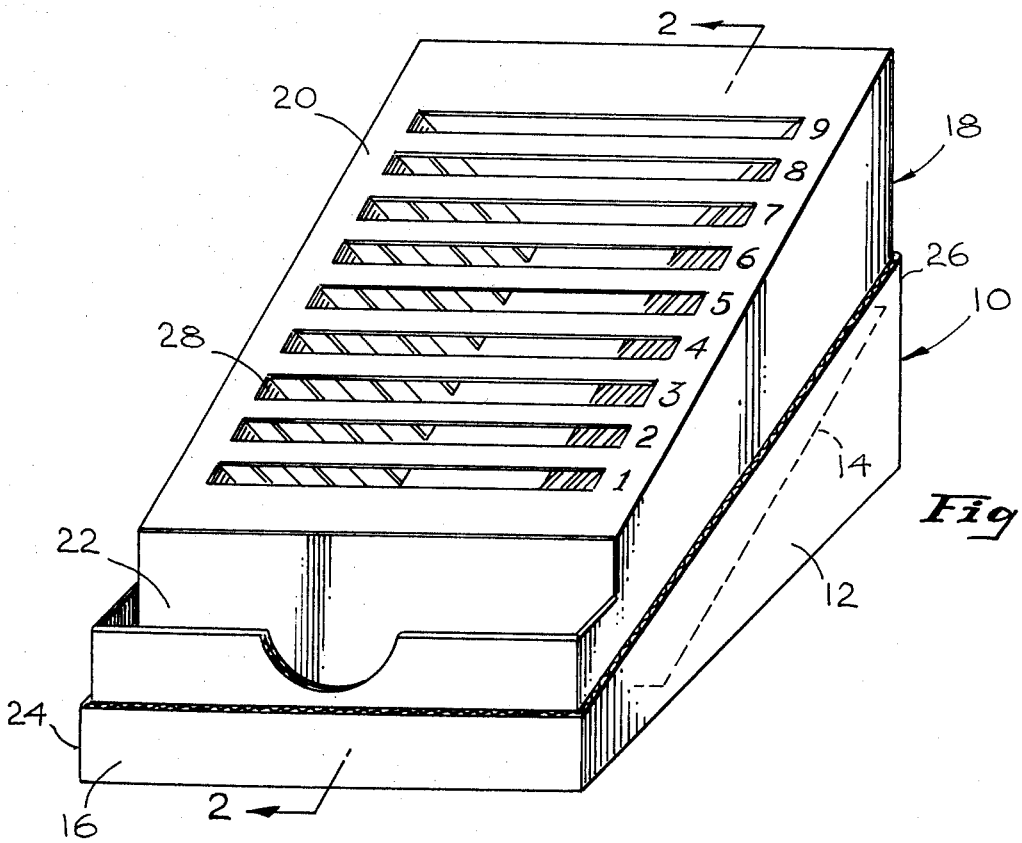
FIG. 1 is an isometric view of the scaling or "vignette" box according to my invention.
Figure 2:
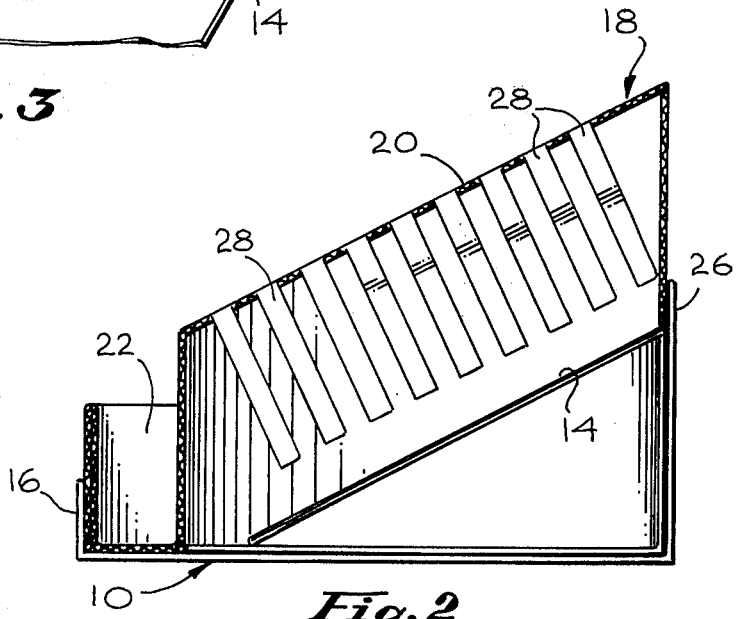
FIG. 2 is a view, partially in section, taken along the line 2 — 2 in FIG. 1.

In FIG. 1, base 10, which may be formed of paperboard or lightweight plastic, includes sidewall 12 and sloping floor 14 (which can be seen more clearly in FIG. 2). Sloping floor 14 extends the width of front wall 16.

Superstructure 18, which includes polling-scale surface 20 and card caddy portion 22, nests, removably, within the sidewalls 12 and 24, front wall 16 and rear wall 26 of base 10. Polling-scale surface 20 contains a plurality of slots numbered 1 through 9 therein. These slots may be formed by stamping or cutting and, in their forming process, spreaders 28, seen in FIG. 2, are formed. Their function will be described in connection with a discussion of that Figure.

It is to be noticed that polling-scale surface 20 slopes upwardly to make viewing of the numbered slots by the user more convenient and insertion of cards in those slots more accurate. It should also be noted that the number of slots is odd. This is an intentional element of the design of the vignette box for it provides a middle or neutral slot in which the respondent may insert a position card if the respondent has no leanings to either favor or disfavor the position set forth on the card. The number of slots does not have to be nine, as here shown, but the number should be odd to permit the respondent to take a neutral position on a question or issue.

Turning to FIG. 2, superstructure 18 is shown nested within base 10 with spreaders 28 extending towards floor 14. The function of these spreaders is more apparent from FIG. 3. The fabrication of base 10 and superstructure 18 from cardboard or, more specifically, paper boxboard, results in a lightweight device which is low cost and may be easily transported to a field location, if desired.

Figure 3:
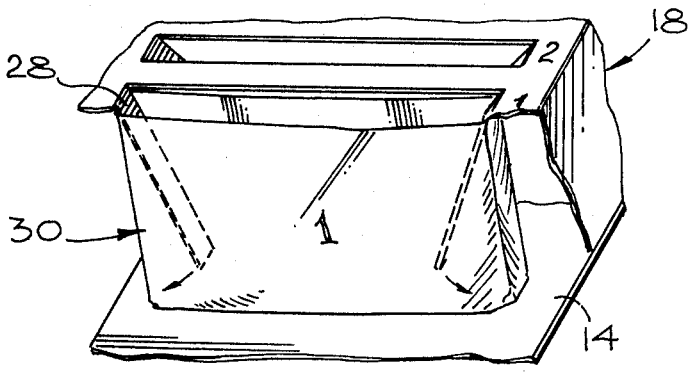
FIG. 3 is a diagram showing how certain of the elements of FIG. 2 function; and, FIG. 4 is a representative punch card element for use in the apparatus of FIGS. 1 through 3.

Before the vignette box is used, superstructure 18 is removed from base 10 and, as shown in FIG. 3, envelopes 30 bearing numbers (or other indicia) corresponding to the slot indicia on polling-scale surface 20, are applied to spreaders 28 and superstructure 18 is returned to its operating position nested in base 10. Spreaders 28 retain the empty envelopes open and beneath their respective slots during this re-assembly process. The bottom edges of envelopes 30 rest on sloping floor 14 with those bottom edges of envelopes 30 tending to slope toward the front wall 16 of base 10. This is important because, upon completion of a polling, superstructure 18 is removed from base 10 and there may be some tendency for envelopes 30 to fall off spreaders 28. With the built-in bias provided by sloping floor 14, the tops of the envelopes remain oriented upwardly and the contents of the envelopes are not lost in the disassembly process. After they are removed, envelopes 30 are sealed, of course, eliminating any further potential loss problem.

Figure 4:
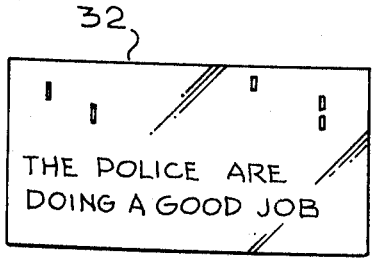

FIG. 4 illustrates a pre-punched computer card 32 carrying a potential position statement on which a poll can (and has) been taken. While a single language (English) is illustrated it is apparent that the statement may be presented in any language or combination of languages. The respondent may review the statement at his own speed and contemplate into which slot it should be dropped. The card has been punched to reflect the statement and in computer processing the slot chosen by the respondent as reflecting his reaction to the statement will be indicated by the envelope in which the card is received at the processing center.

While a particular embodiment of my invention has been shown and described, it should be understood that this invention is not limited to that embodiment and that all devices which follow hereinafter are intended to be included within the scope of this invention.

I claim:

1. A polling box for use in poll-taking on issues having a scale of human responses thereto which lies over a range from agreement to disagreement, including:

a base portion having a front wall and a floor supported in said base portion and sloping downwardly toward said front wall, and, a superstructure removable as a unit and sized to nest within said base portion and having a polling-scale surface sloped similarly to said floor in said base portion, said polling-scale surface having a plurality of slots therein adapted to receive cards bearing thereon recitations of specific issues on which poll-taking is being conducted, each of said slots bearing a gradation identifier which lies in a progressive series of identifiers from the first of said slots to the last thereof, and each of said slots having separator means depending from opposite ends thereof for holding open removable envelopes placed beneath each of said slots to receive said cards.

2. Apparatus according to claim 1 in which said separator means are integral with said polling-scale surface.

3. Apparatus according to claim 1 in which each of said scaling index identifiers is a unique number between 1 and 9 and said slot nearest said front wall when said superstructure is nested within said base bears the number "1".

4. Apparatus according to claim 1 in which the number of index identifiers in the series is an odd number.

5. Apparatus according to claim 1 in which said base portion and said superstructure are of paperboard.

* * * * *